US012104439B2

(12) United States Patent
Chen

(10) Patent No.: US 12,104,439 B2
(45) Date of Patent: Oct. 1, 2024

(54) SHAPED CUTTER WITH RIDGES AND MULTI-TAPERED CUTTING FACE

(71) Applicant: Halliburton Energy Services, Inc., Houston, TX (US)

(72) Inventor: Shilin Chen, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 90 days.

(21) Appl. No.: 17/956,647

(22) Filed: Sep. 29, 2022

(65) Prior Publication Data

US 2024/0110446 A1 Apr. 4, 2024

(51) Int. Cl.
*E21B 10/567* (2006.01)
*E21B 10/43* (2006.01)
*E21B 10/55* (2006.01)

(52) U.S. Cl.
CPC ..... *E21B 10/5673* (2013.01); *E21B 10/43* (2013.01); *E21B 10/55* (2013.01)

(58) Field of Classification Search
CPC ..... E21B 10/5673; E21B 10/5676
See application file for complete search history.

(56) References Cited

U.S. PATENT DOCUMENTS 4,984,642 A * 1/1991 Renard ..... E21B 10/5673 175/430
D317,010 S * 5/1991 Knemeyer ..... D15/139
5,172,778 A * 12/1992 Tibbitts ..... E21B 10/5673 175/420.1
8,025,107 B2 9/2011 Drivdahl et al.
8,327,956 B2 12/2012 Drews et al.
8,561,727 B1 * 10/2013 Pope ..... E21B 10/5735 175/420.1

(Continued)

FOREIGN PATENT DOCUMENTS

WO 2007127680 11/2007
WO 2021041753 3/2021

OTHER PUBLICATIONS

Xie, Dou; Huang, Zhiqiang; Yan, Yuqi; Ma, Yachao; Yuan, Yuan (2020). Application of an innovative ridge-ladder-shaped polycrystalline diamond compact cutter to reduce vibration and improve drilling speed. Science Progress, 103 (3), 003685042093097-.

(Continued)

*Primary Examiner* — Blake Michener
(74) *Attorney, Agent, or Firm* — Michael Jenney; C. Tumey Law Group PLLC

(57) ABSTRACT

A shaped cutter has a plurality of ridges extending in parallel across a cutting face to enhance drilling. The cutting table is also multi-tapered, being convex along a first cross-section perpendicular to the ridges and concave along a second cross-section parallel with the ridges. The shaped cutter may enhance rock failure modes in addition to shearing, such as by indentation, impacting, scraping and grinding. The plurality of ridges may also exploit vibrations in the drill string to enhance rock failure. The cutting table may be positioned on a drill bit to define an internal back rake angle with respect to a slope angle where the cutting table is concave. The cutting table may include a flared periphery, resulting in a sharper indentation angle and/or larger radius of contact with the formation.

20 Claims, 7 Drawing Sheets

(56) References Cited

U.S. PATENT DOCUMENTS

| | | | | |
|---|---|---|---|---|
| 8,833,492 | B2 | 9/2014 | Durairajan et al. | |
| 8,851,206 | B2 | 10/2014 | Patel | |
| 11,098,532 | B2 | 8/2021 | Gan et al. | |
| 11,215,012 | B2 | 1/2022 | Chen et al. | |
| 2017/0122037 | A1* | 5/2017 | Morse | E21B 10/56 |
| 2018/0334860 | A1* | 11/2018 | Azar | E21B 10/5673 |
| 2019/0338599 | A1* | 11/2019 | Bellin | E21B 10/55 |
| 2020/0018122 | A1* | 1/2020 | Keller | E21B 10/55 |
| 2020/0347680 | A1 | 11/2020 | Tian et al. | |
| 2022/0003046 | A1 | 1/2022 | Yu et al. | |

OTHER PUBLICATIONS

Development and Verification of Triple-Ridge-Shaped Cutter for PDC Bits, Shao, et al., SPE Journal, 2022.

* cited by examiner

SHAPED CUTTER WITH RIDGES AND MULTI-TAPERED CUTTING FACE

BACKGROUND

Wells are constructed in subterranean formations in an effort to extract hydrocarbon fluids such as oil and gas. A wellbore may be drilled with a rotary drill bit mounted at the lower end of a drill string. The drill string is assembled at the surface of a wellsite by progressively adding lengths of tubular drilling pipe to reach a desired depth. The drill bit is rotated by rotating the entire drill string from the surface of the well site and/or by rotating the drill bit with a downhole motor incorporated into a bottomhole assembly (BHA) of the drill string. As the drill bit rotates against the formation, cutters on the drill bit disintegrate the formation in proximity to the drill bit. Drilling fluid ("mud") is circulated through the drill string and the annulus between the drill string and the wellbore to lubricate the drill bit and remove cuttings and other debris to surface.

Rotary drill bits are generally categorized as fixed cutter (FC) bits having discrete cutters secured to a bit body at fixed positions (i.e., fixed cutters), roller cone (RC) bits having rolling cutting structures (i.e., roller cones), or hybrid bits comprising both fixed cutters and rolling cutting structures. A fixed cutter typically has a diamond-based cutting table secured to a metal carbide substrate. The substrate is secured to the bit body with the cutting table at a particular orientation and position, thereby exposing some portion of the cutting table to the formation. A fixed cutter traditionally has a cylindrical substrate with a round cutting table. However, as diamond manufacturing continues to improve, more nuanced cutting table shapes continue to be developed that provide various technical advantages.

BRIEF DESCRIPTION OF THE DRAWINGS

These drawings illustrate certain aspects of some examples of the present disclosure and should not be used to limit or define the disclosure.

DETAILED DESCRIPTION

Various shaped cutters are disclosed for use on a drill bit or other wellbore forming tool. The shaped cutters may be fixed cutters, formed as a polycrystalline diamond compact (PDC) utilizing one or more high-pressure, high-temperature (HTHP) press cycle. The design of the disclosed shaped cutter includes various functional aspects to enhance rock removal while drilling. The shaped cutter may cut rock by shearing, and by virtue of its shape, may also enhance other rock failure modes, including but not limited to indentation, impacting, scraping and grinding.

In one aspect, the shaped cutter includes a plurality of ridges extending in parallel along the cutting table from one location on a periphery of the cutting table to another location on the periphery. The cutter may be positioned on the drill bit with the ridges exposed at one end to the formation so the ridges may generate multiple cracks in the formation while drilling. After the ridges become worn, the cutter may be repositioned on the drill bit to expose an opposite end of the ridges, such as during a repair, refurbish, or maintenance operation.

In another aspect, the cutting face is multi-tapered, in that the cutting table is convex along a first cross-section perpendicular to the ridges and concave along a second cross-section parallel with the ridges. Thus, the cutting table may taper outwardly in the first cross-section and taper inwardly in the second cross-section. This cutter geometry may also be used to modify a back rake angle for the cutter engaging the formation as compared with the back rake angle of a conventional cylindrical cutter at the same relative orientation on the bit body. The cutter geometry may also provide a sharper indentation angle than would otherwise be present in a conventional cutter.

The shape of the disclosed cutters may also make productive use of the presence of vibrations in the drill string, which may include both torsional and axial vibration components. Aspects of the disclosed cutter designs were conceived, in part, on a recognition that a PDC bit has almost always some type of vibration in drilling, especially in relatively hard formations. Vibration in a cutting direction may help the ridges to generate more cracks in the formation in front of the radial ridges. Energy may be distributed over the multiple cracks to increase a frequency and/or reduce an amplitude of a vibration frequency while drilling. Torsional vibrations propagating to a drill bit may be used to enhance cutting with the use of a non-planar (e.g., tapered) cutter surface at locations where a conventional cutter may otherwise have a planar surface. Axial vibrations propagating to the drill bit may also be used to enhance cutting with a sharper cutting angle to increase cutter indentation.

Figure 1:
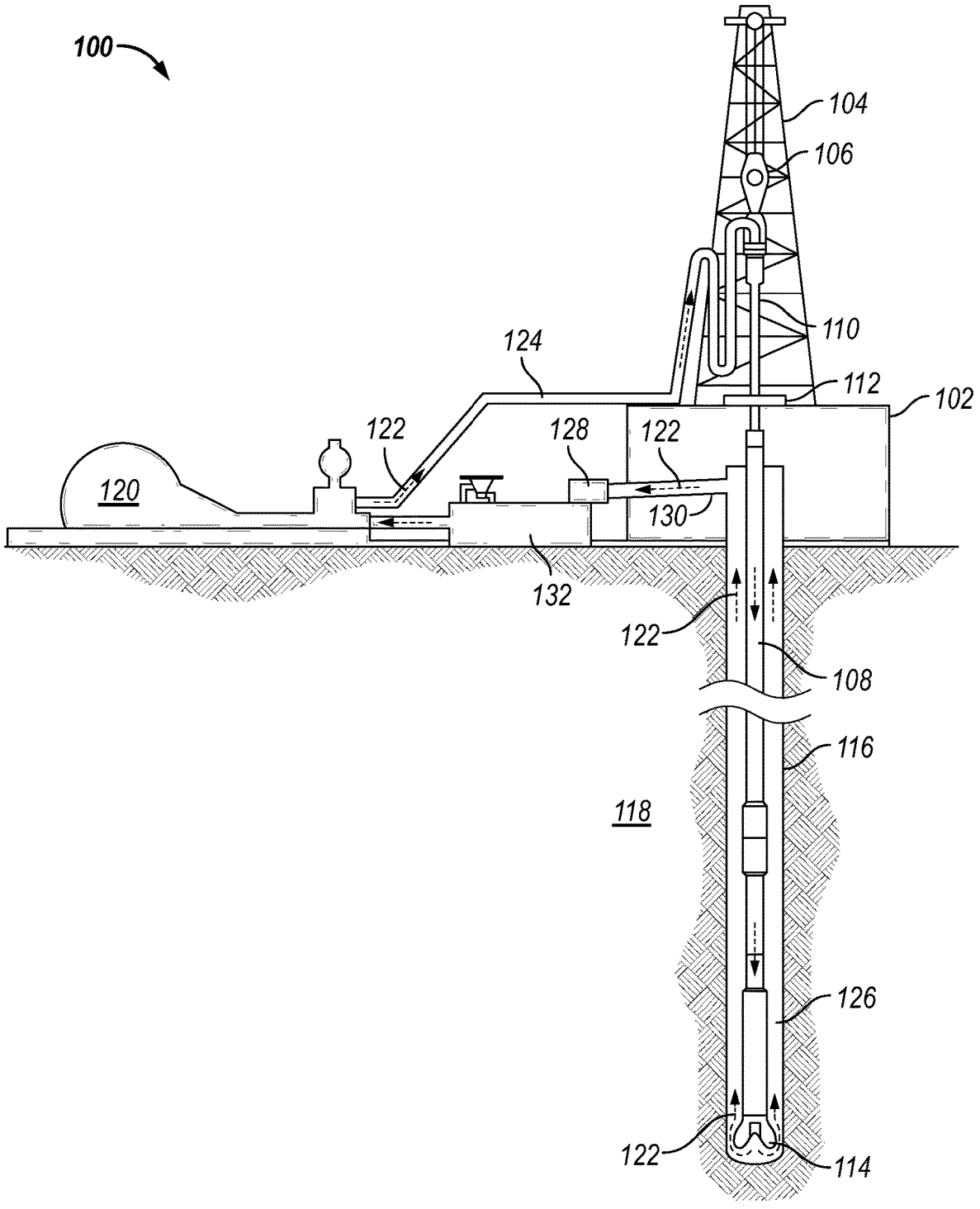
FIG. 1 illustrates a side elevation, partial cross-sectional view of an operational environment in accordance with one or more embodiments of the disclosure.

FIG. 1 is an elevation, partially cross-sectional view of a representative well site at which a wellbore may be formed by drilling and other operations. While FIG. 1 generally depicts land-based drilling, the principles described herein are applicable to subsea drilling operations that employ floating or sea-based platforms and rigs, without departing from the scope of the disclosure. As illustrated, a drilling rig 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A rotary drill bit 114 is attached to the distal end of the drill string 108 and may be rotated by via rotation of the drill string 108 from the well surface and/or a downhole motor. The drill bit 114 is a wellbore forming tool that is used to initially form a wellbore 116 in a subterranean formation 118. Other wellbore forming tools may be included on the drill string for use in certain drilling operations, such as one or more hole opener and/or reamer to selectively widen a portion of the wellbore 116, or a coring bit used to obtain and retrieve a sample of the formation for analysis.

The drill bit 114 may be a fixed-cutter or hybrid drill bit having one or more fixed cutters, including one or more shaped cutters as disclosed herein to enhance rock removal. A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the wellbore 116. At the surface, the recirculated or spent drilling fluid 122 exits the annulus 126 and may be conveyed to one or more fluid processing unit(s) 128 via an interconnecting flow line 130. After passing through the fluid processing unit(s) 128, a "cleaned" drilling fluid 122 is deposited into a nearby retention pit 132 (i.e., a mud pit). While illustrated as being arranged at the outlet of the wellbore 116 via the annulus 126, those skilled in the art will readily appreciate that the fluid processing unit(s) 128 may be arranged at any other location in the drilling rig 100 to facilitate its proper function, without departing from the scope of the scope of the disclosure.

Figure 2:
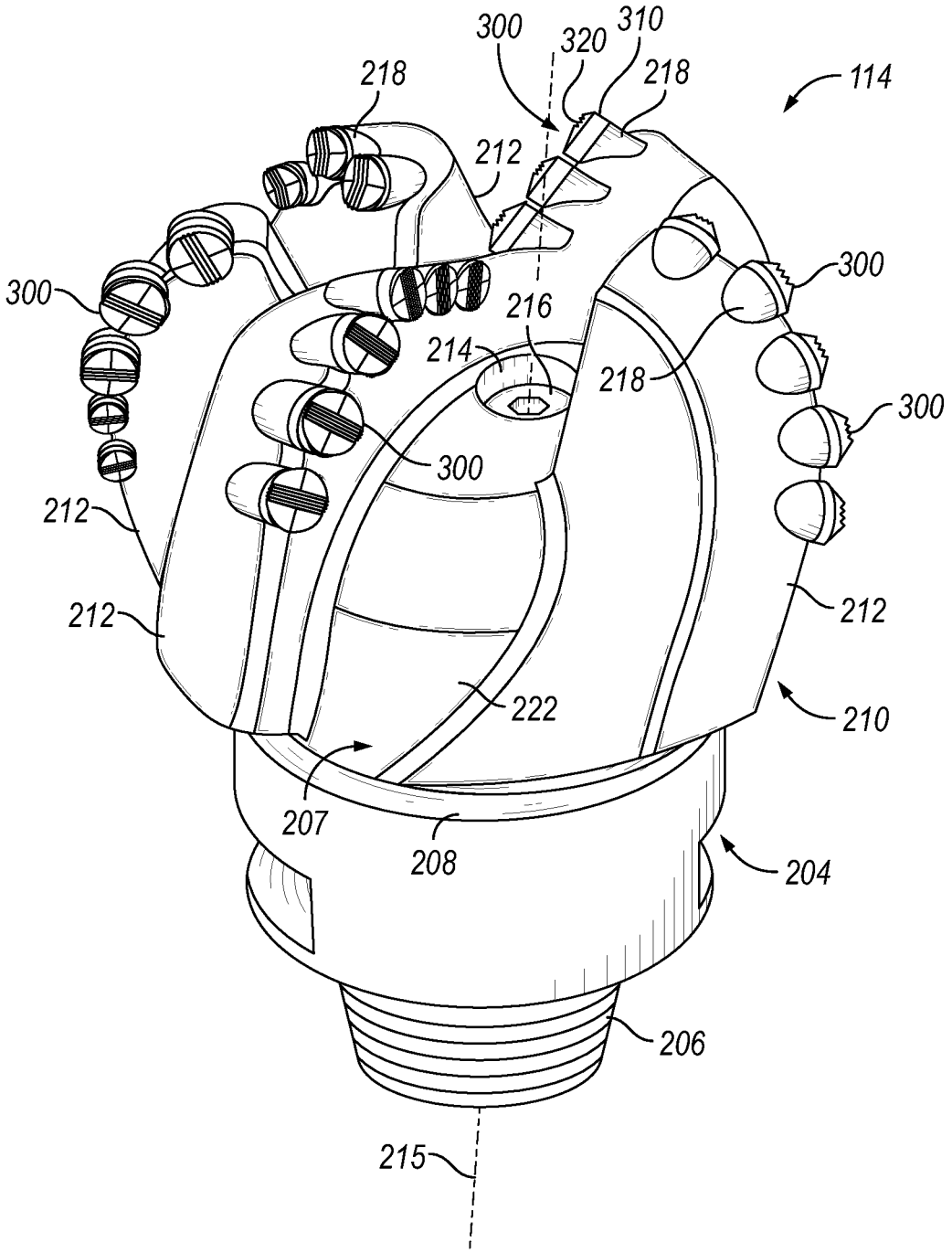
FIG. 2 illustrates an isometric schematic drawing of an exemplary fixed-cutter drill bit in accordance with one or more embodiments of the disclosure.

FIG. 2 is a perspective view of the drill bit 114 as an example of a wellbore forming tool that may employ shaped cutters and other aspects of the present disclosure. The drill bit 114 includes a rigid bit body 210 to which a plurality of fixed cutters may be secured, of which one or more may be a disclosed shaped cutter 300. In some embodiments, the bit body 210 may be formed by a metal-matrix composite, such as tungsten carbide reinforcing particles dispersed in a binder alloy. The bit body 210 includes a plurality of blades 212 formed on the exterior of the bit body 210. The blades 212 may be spaced from each other to form fluid flow paths or junk slots 222 therebetween. A plurality of cutter pockets 218 are formed on the blades 212 to receive cutters at predetermined positions. As illustrated, all of the cutters are shaped cutters 300 according to this disclosure. However, other embodiments may include one or more of the shaped cutters 300 in combination with other cutters, such as conventional round/flat cutters or other cutter shapes. Each shaped cutter 300 includes a substrate 310 and a cutting table 320 secured to the substrate 310. The substrate 310 is received by the respective cutter pocket 218 and secured within the cutter pocket 218 such as by brazing.

The bit body defines a bit axis 215 about which the drill bit 114 may rotate while drilling. The bit axis 215 may coincide at least approximately with a center of mass of the drill bit 114. The bit axis 215 may be generally aligned with an axis of a drill string or other conveyance to which the drill bit 114 is coupled. Drill bits may be connected in any of an unlimited number of ways to a drill string, coiled tubing, or other conveyance to allow for rotation about the bit axis 215. In this example, the drill bit 114 may include a metal shank 204 with a mandrel or metal blank 207 securely attached thereto (e.g., at weld location 208). The metal blank 207 extends into bit body 210. The metal shank 204 includes a threaded connection 206 distal to the metal blank 207 for securing the drill bit 114 to a drill string, which connection may generally align the bit axis 215 with an axis of the drill string or other desired axis of rotation.

While drilling, an axial force such as weight on bit (WOB) may be applied in a direction of the bit axis 215, such that the cutters 300 engage the formation being drilled. Simultaneously, the drill bit 114 is rotated about the bit axis 215 to engage the earthen formation to cut material ("rock") from the formation. The shaped cutters 300 have particular shapes, such as disclosed below in specific examples, that may enhance the removal of rock while drilling. Drilling fluid circulated downhole may lubricate the drill bit 114 and remove the cuttings and other fluid contaminants to the surface, such as generally described above in relation to FIG. 1. A nozzle 216 may be positioned in each nozzle opening 214 and positioned to clear cuttings/chips of formation material from the shaped cutters 300 through evacuation features of the bit 114, including junk slots 222.

Figure 3:
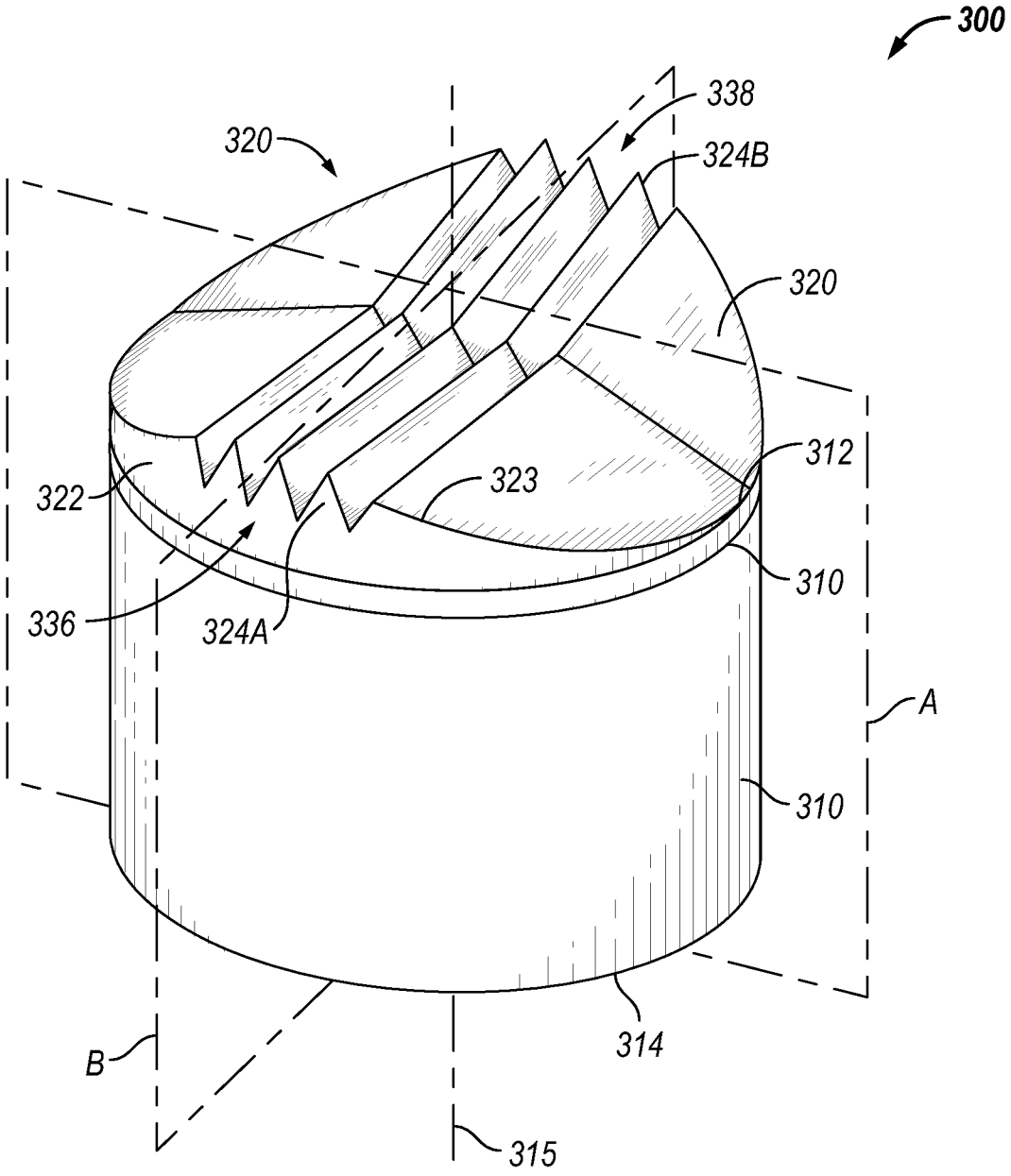
FIG. 3 is a perspective view of a shaped cutter for a fixed cutter drill bit according to an example embodiment.

FIG. 3 is a perspective view of a shaped cutter 300 for a fixed cutter drill bit according to an example embodiment. The shaped cutter includes a substrate 310 having a proximal end 312 and a distal end 314. A cutting table 320 is secured to the proximal end 312 of the substrate 310 at a cutter-substrate interface 302. The cutter 300 optionally has a generally cylindrical form factor, at least along the substrate and to a periphery 322 of the cutting table 320, with a cutter axis 315 passing centrally through the proximal end 312, distal end 314, and the cutting table 320. The periphery 322 of the cutting table 320 is generally circular, as is the substrate 310. The substrate 310 and cutting table 320 have the same or similar diameter and circumference at least at the cutter-substrate interface 302. An exposed surface of the cutting table 320 opposite the cutter-substrate interface defines a cutting face 321, on which various cutting structures are formed.

Cutting structures of the cutting table 320 in this example includes a plurality of ridges 330 that extend straight across the cutting face 321 in parallel to one another. A cutting edge 323 comprises an edge of the cutting table 320 that may be exposed for cutting a formation while drilling. The cutting edge 323 in this example is defined along the periphery 322 inclusive of a toothed profile of the ridges 330 along this cutting edge 323. The cutting edge 323 extends beyond the ridges 330 that also may contact the formation. The plurality of ridges 330 traverse the cutting face 321, collectively terminating at a first end 336 and at a second end 338 opposite the first end 336. Each ridge 330 extends from one location on the periphery 322 to another location on the periphery 322. For example, one of the ridges 330 extends from a first location 324A on the periphery 322, across the cutting face 321, to a second location 324B on the periphery 322.

The cutting table 320 may be formed in a variety of ways, such as by molding and/or more machining. A molding step may entail placing diamond material into a pressing can having a desired pre-form for defining an initial shape of the diamond table 320 and undergoing one or more HTHP press cycles. For example, the cutting table 320 may be originally formed as a PCD blank having a generally cylindrical or round and flat shape prior to machining the ridges 330 into the cutting table 320. Alternatively, the cutting table 320 may be formed as a PCD blank that includes finished or unfinished ridges, which may or may not require finishing steps such as machining following one or more HTHP press cycles.

Additional reference geometry is provided in FIG. 3 to facilitate explaining certain features of the cutter 300. The reference geometry includes the cutter axis 315, which passes centrally through the cutter 300, a first plane, i.e., Plane "A" that contains the cutter axis 315, and a second plane, i.e., Plane "B" orthogonal to Plane A that also contains the cutter axis 315. Plane A is perpendicular to the ridges 330 and Plane B is therefore parallel to the ridges 330. The cutting table 320 is convex along a first cross-section perpendicular to the ridges 330, either along or parallel to Plane A. The cutting table 320 is simultaneously concave along a second cross-section that is parallel with the ridges 330, either along or parallel to Plane B. In the example of FIG. 3, more particularly, the cutting table 320 is convex along any given plane parallel to Plane A that passes through the cutter 300, and the cutting table 320 is concave along any given plane parallel to Plane B through the cutter 300.

The cutter 300 may initially be secured to a bit body of a drill bit, such as described in and shown in FIG. 2. The cutter may be initially positioned about the cutter axis 315 so that the ridges 330 at one of the two ends 336, 338 is oriented for engaging a formation during drilling. When that one of the two ends 336, 338 becomes worn from drilling, rather than replacing the cutter 300, the cutter 300 may be removed and re-attached to the drill bit with the other of the two ends 336, 338 oriented for engaging the formation, e.g., rotated 180 degrees about the cutter axis 315.

Figure 4:
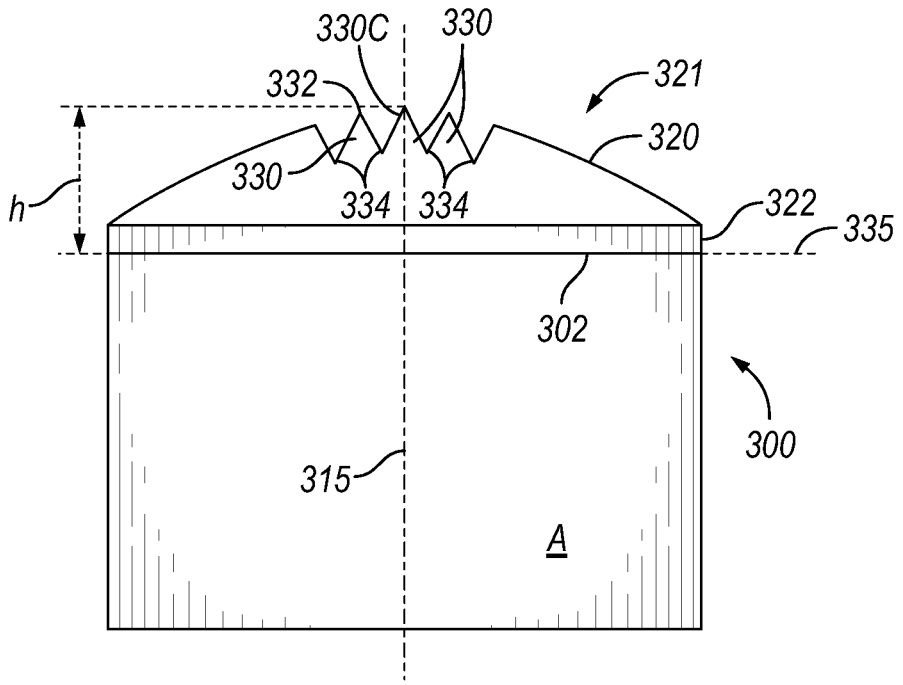
FIG. 4 is a cross-section of the shaped cutter 300 along a first plane perpendicular to the ridges.

FIG. 4 is a cross-section of the cutter 300 of FIG. 3 taken along Plane A, which is perpendicular to the ridges 330. The cutting face 321 is convex in Plane A, in that it generally tapers from the periphery 322 toward the cutter axis 315. In this example, the cutting table 320 generally slopes upward in Plane A from the periphery 322 to a high point at a central ridge 330C. Each ridge 330 comprises a peak 332 and a valley 334 on each side of and axially below the peak 332. Each ridge 330 has a ridge height "h" at any given point along its peak 332 defined herein as a perpendicular distance from the point along the peak 332 to an orthogonal reference plane below the ridges 330. The orthogonal plane is a reference plane that does not necessarily coincide with (e.g., can be below) the ridges; the heights in this context are not the peak-to-valley heights of the ridges. In FIG. 4, the orthogonal reference plane 335 is along the cutter-substrate interface 302. The plurality of ridges 330 include a central ridge 330C passing through the cutter axis 315. The central ridge 330C has the highest ridge height h of any of the plurality of ridges 330 in Plane A, and optionally, in any given plane parallel to Plane A.

The cutting table 320 includes three ridges 330 by way of example, but other embodiments may include a different number of ridges 330. There are possible design trade-offs between the number of ridges and the size of each ridge. For example, increasing the number of ridges 330 may desirably increase the number of contact points on the formation being drilled, thereby increasing the number of cracks that may be generated in the formation. Conversely, fitting a larger number of ridges onto the cutting table may corresponding reduce certain dimensions of the ridges 330 such as their heights or peak-to-valley distance. A preferred range for the number of ridges per cutter is typically between three and seven ridges.

Figure 5:
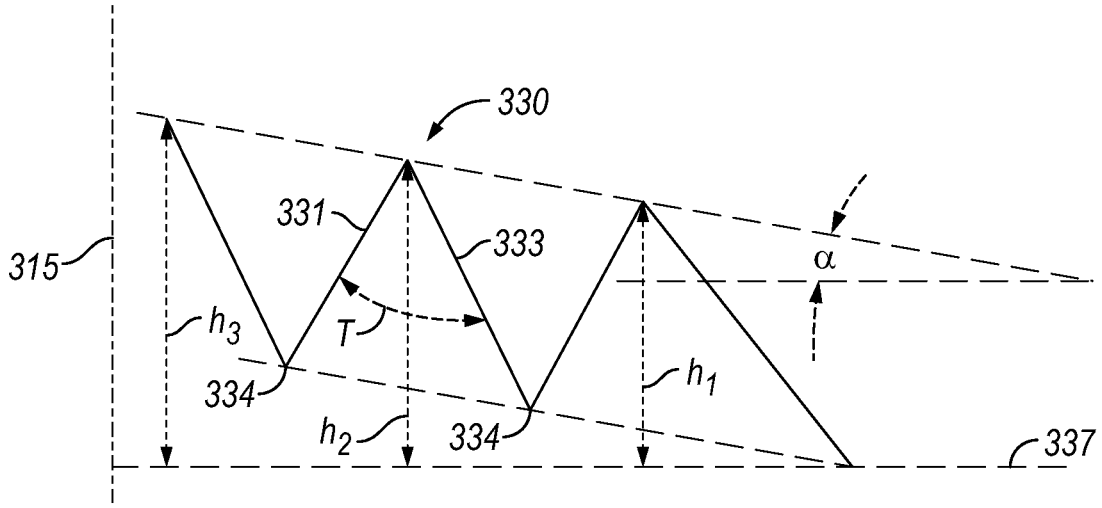
FIG. 5 is a schematic diagram of the ridge geometry.

FIG. 5 is a schematic diagram of ridge geometry in Plane A perpendicular to the plurality of ridges 330. A horizontal reference line 337 is perpendicular to the cutter axis 315 and lies in a plane orthogonal to the cutter axis 315. The ridge heights h1, h2, h3, etc. of the respective ridges 330 increase consecutively in Plane A in a direction toward the cutter axis 315. Optionally, the ridge heights increase linearly in Plane A, such that the peaks 332 all lie along a slope angle "a," which may be some angle between 5 and 15 degrees. A distance from each valley 334 to the horizontal reference line 337 also increases in Plane A in a direction toward the cutter axis 315. The peaks 332 may also all lie along a slope angle between 5 and 15 degrees. The slope angle of the peaks may be equal to the slope angle of the valleys in some embodiments. In other embodiments the slope angles of the peaks and valleys may be different.

Each ridge 330 comprises a surface pair 331, 333 intersecting along the respective peak 332, forming a toothed shaped in Plane A at a ridge (or tooth) angle "T". The surface pair 331, 333 extends perpendicular to Plane A (into the page in FIG. 5). The ridge angle T in some embodiments may be relatively wide, in a range from 50 up to 140 degrees. In other embodiments, the ridges may be sharper, with a ridge angle T in a narrower range from 50 up to at most 80 degrees. The peak 332 may be relative sharp, such as with a chamfer as small as about 0.005 inches (0.127 mm). Alternatively, the peak 332 may be blunted, such as with a flat or oval shape in a range of between 0.02 inches (0.5 mm) to 0.079 inches (2.0 mm). Thus, a relatively blunt ridge may have a ridge angle T as wide as 140 degrees with a flat portion of up to 2 mm, whereas a relatively sharp ridge may have a ridge angle T as narrow as 50 degrees and an unfinished peak or a peak having a chamfer as small as 0.005 inches.

Figure 6:
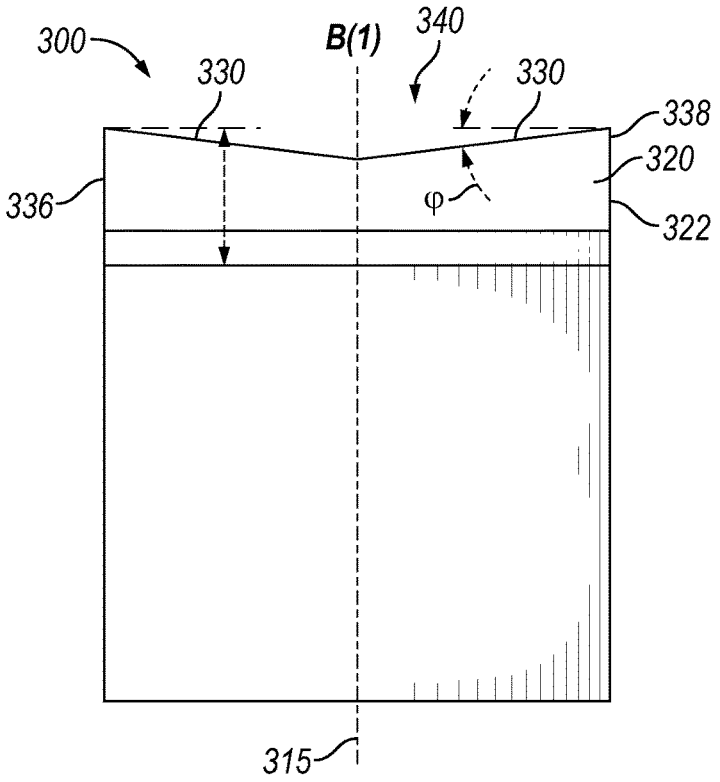
FIG. 6 is a schematic diagram of a concave cross section taken along the first plane.
Figure 7:
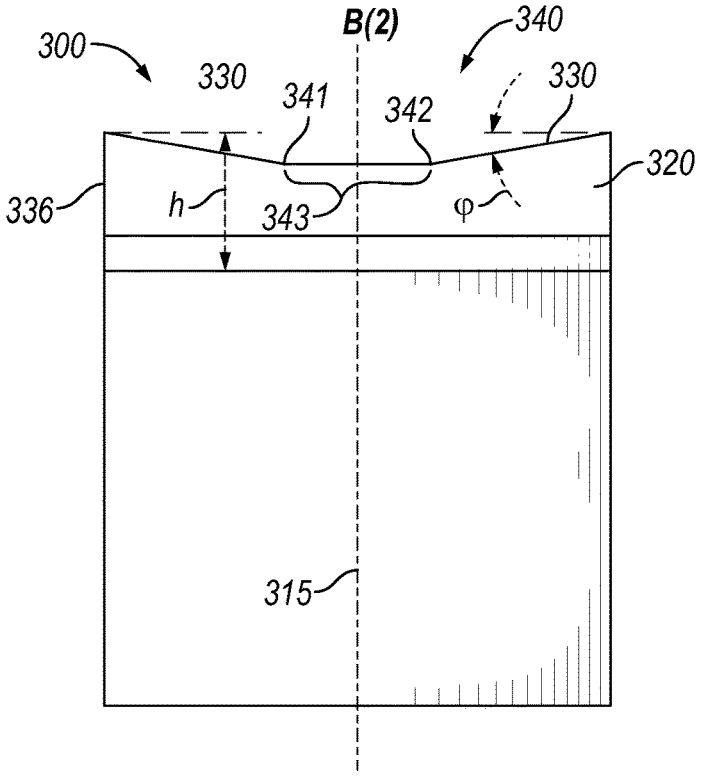
FIG. 7 is a schematic diagram of an alternative concave cross section.
Figure 8:
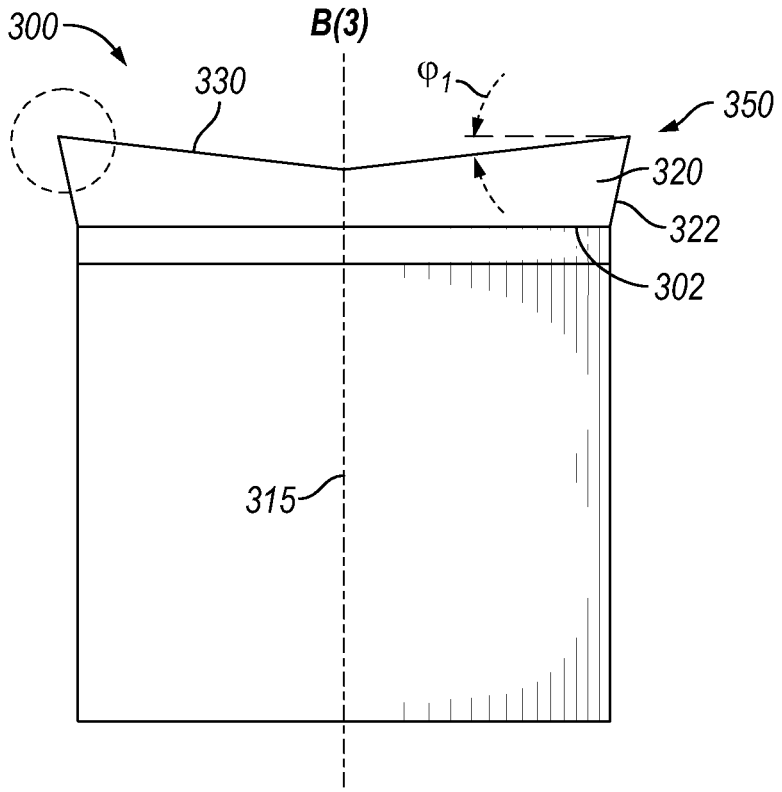
FIG. 8 is a schematic diagram of another concave cross section, wherein the periphery of the cutting table flares radially outwardly to define an outward camber.

FIGS. 6-8 are schematic diagrams of various examples of a cross-section parallel with the ridges of a shaped cutter. As discussed above, the cutting table may be convex in Plane A. The cutting table may simultaneously be concave in Plane B. Therefore, FIGS. 6-8 provide alternative examples of cutting tables that may be concave in Plane B.

FIG. 6 is a schematic diagram of a concave cross section B(1) of the cutter 300 taken along Plane B of FIG. 3. The ridges 330 are oriented parallel with each other and with Plane B, extending across the cutting table 320 from the first end 336 to the second end 338, each terminating at the periphery 322 of the cutting table 320. The cutting table includes a concave portion 340 that comprises a downward slope of the ridges 330 at an internal back rake angle "φ". The back rake angle φ is a reference angle that affects how the cutting table 320 engages a formation, as further discussed below in FIG. 10. In B(1), the ridge height "h" decreases from the periphery 322 of the cutting table 320 all the way to a center of the cutting table 320 at the cutter axis 315.

FIG. 7 is a schematic diagram of an alternative concave cross section B(2) of the cutter 300. In this example, the concave portion 340 of the cutting table 320 again comprises a downward slope of the ridges 330 at an internal back rake angle "φ". However, the ridge height h decreases from the periphery 322 of the cutting table 320 only part of the way toward the cutter axis 315, to locations 341, 342. The ridge height of each ridge is then constant the rest of the way to the cutter axis 315. The cross section is generally flat along a region 343 radially inward of locations 341, 342, with a constant ridge height h in that region 343.

Figure 9:
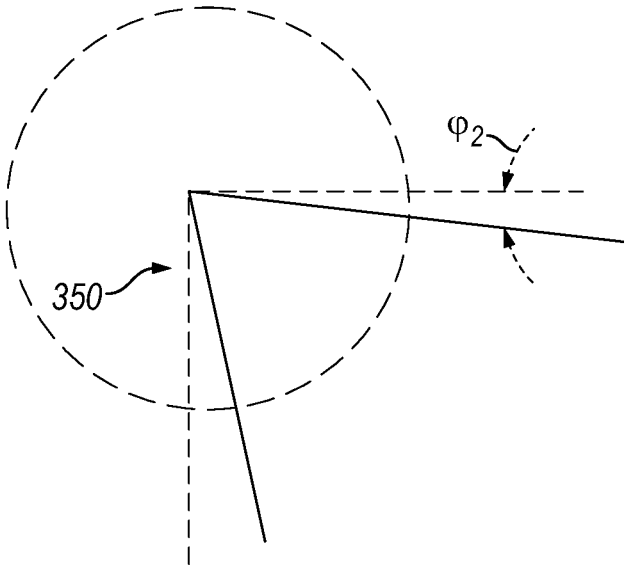
FIG. 9 is an enlarged, detailed view of the outward camber of FIG. 8.

FIG. 8 is a schematic diagram of another concave cross section B(3) of cutter 300 taken along Plane B. The periphery 322 of the cutting table 320 flares radially outwardly in an axial direction away from the cutter-substrate interface to define an outward camber 350 from the cutter-substrate interface 302. The cutting table 320 includes a concave portion 340 that, like in the cross section B(1) of FIG. 6, comprises a back rake angle $\varphi_1$ along the ridges 330 all the way to the cutter axis 315. The ridge height h likewise decreases from the periphery 322 of the cutting table 320 all the way to the cutter axis 315. The back rake angle (in may be in the range of less than 5 degrees in some examples, but can be greater than 5 degrees in other examples. The outward camber 350, enlarged for detail in FIG. 9, defines a camber angle $\varphi_2$ that may be between 0 and 10 degrees with respect to the cutter centerline 315 in some examples, or greater than 10 degrees in other examples.

Figure 10:
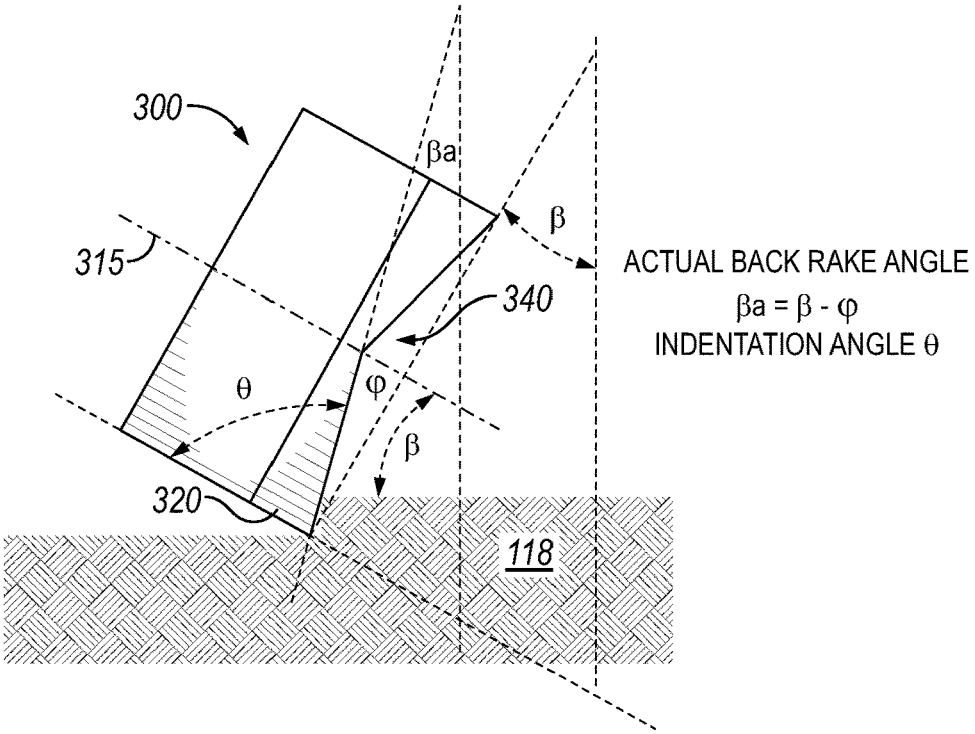
FIG. 10 is a schematic diagram of a shaped cutter with the concave profile of FIG. 6 while drilling.

FIG. 10 is a schematic diagram of a shaped cutter 300 with a concave profile 340 like that of FIG. 6, while engaging the formation 118 during drilling. The cutter axis 315 is oriented in the plane of FIG. 10 (concave cross-section B(1)) at an angle β with respect to the surface of the formation 118 being cut, which is also the nominal back rake angle β between vertical and what is normally a flat (not concave) cutting table. The internal back rake angle φ as described above reduces the effective (i.e., actual) back rake angle. Thus, the actual back rake angle $\beta a=\beta-\varphi$. The reduced actual back rake angle may increase cutting efficiency, especially in soft formations. This correspondingly reduces an indentation angle θ. The reduced indentation angle may also enhance cutting efficiency in soft formation.

Figure 11:
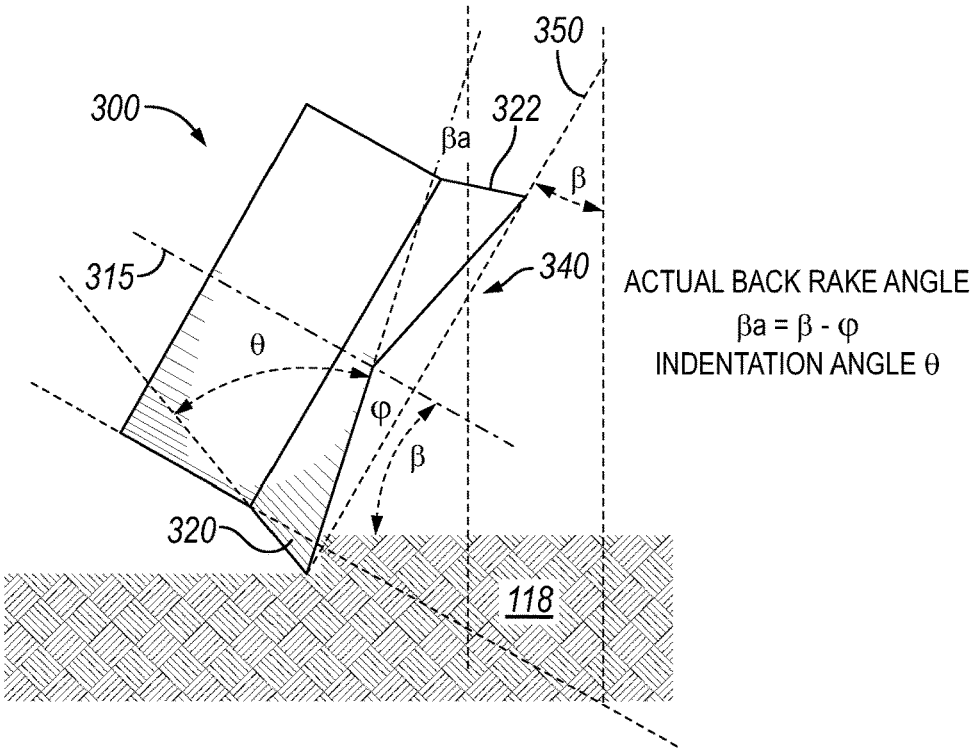
FIG. 11 is a schematic diagram of the shaped cutter with the concave profile of FIG. 8 while drilling.

FIG. 11 is a schematic diagram of the shaped cutter 300 having a concave profile 340 like that of FIG. 8 while engaging the formation 118 during drilling. The cutter axis 315 is oriented in the plane of FIG. 11 (concave cross-section B(3)) at an angle β with respect to the surface of the formation 118 being cut, which is also the nominal back rake angle β between vertical and what is normally a flat (not concave) cutting table. The internal back rake angle φ as described above again reduces the effective (i.e., actual) back rake angle. Thus, the actual back rake angle is $\beta a=\beta-\varphi$, with an indentation angle θ.

However, the periphery 322 of the cutting table flares outwardly resulting in the camber 350, which defines a generally frustoconical surface. This camber 350 results in a narrower indentation angle θ and a correspondingly sharper cutting edge than in FIG. 10. The overall shape of the shaped cutter 300 may exploit the presence of vibrations in the drill string, which may include both torsional and axial vibration components. For example, torsional vibrations propagating to a drill bit may be exploited with a non-planar cutter surface at locations where a conventional cutter may otherwise have a planar surface. Axial vibrations propagating to the drill bit may also be exploited by the increased indentation angle in FIG. 11.

Therefore, a shaped cutter is disclosed along with a drill bit and a drilling method utilizing such a shaped cutter. The shaped cutter may include a plurality of ridges extending along a cutter face. The cutting face may be concave in a first plane and convex in a second plane perpendicular to the first plane. The shaped cutter drill bit and drilling method may include any combination of features including but not limited to those in the following examples.

Example 1. A shaped cutter for a fixed cutter drill bit, the shaped cutter comprising: a substrate having a proximal end and a distal end, wherein the substrate defines a cutter axis passing centrally through the proximal and distal ends; and a cutting table secured to the proximal end of the substrate at a cutter-substrate interface, the cutting table including a periphery and a plurality of ridges each extending across the cutting table from one location on the periphery to another location on the periphery, each ridge comprising a peak and a valley on each side of and axially below the peak and having a ridge height from the peak to an orthogonal plane along the cutter-substrate interface, wherein the cutting table is convex along a first cross-section perpendicular to the ridges and concave along a second cross-section parallel with the ridges.

Example 2. The shaped cutter of Example 1, wherein the plurality of ridges include a central ridge passing through the cutter axis.

Example 3. The shaped cutter of Example 2, wherein the central ridge has a highest ridge height of the plurality of ridges in the first cross-section.

Example 4. The shaped cutter of any of Examples 1 to 3, wherein the ridge heights of the ridges increase consecutively in the first cross-section from the periphery of the cutting table toward the cutter axis.

Example 5. The shaped cutter of Example 4, wherein the peaks in the first cross-section lie along a slope angle of between 5 and 15 degrees with respect to the orthogonal plane.

Example 6. The shaped cutter of Example 4 or 5, wherein a distance from each valley to the orthogonal plane increases in the first cross-section from the periphery of the cutting table toward the cutter axis.

Example 7. The shaped cutter of Example 6, wherein the valleys in the first cross-section lie along a slope angle of between 5 and 15 degrees with respect to the orthogonal plane.

Example 8. The shaped cutter of any of Examples 1 to 7, wherein the ridge height of each ridge decreases from the periphery of the cutting table toward the cutter axis.

Example 9. The shaped cutter of any of Examples 1 to 8, wherein the ridge height of each ridge decreases along a slope angle of between 5 and 15 degrees from the periphery of the cutting table toward the cutter axis.

Example 10. The shaped cutter of Example 8 or 9, wherein the ridge height of each ridge decreases from the periphery of the cutting table all the way to the cutter axis.

Example 11. The shaped cutter of any of Examples 8 to 10, wherein the ridge height of each ridge decreases at each end from the periphery of the cutting table part of the way toward the cutter axis, and the ridge height of each ridge is constant the rest of the way to the cutter axis.

Example 12. The shaped cutter of any of Examples 1 to 11, wherein one or more of the ridges each comprise a surface pair intersecting along the respective peak at a ridge angle of between 50 to 140 degrees.

Example 13. The shaped cutter of any of Examples 1 to 12, wherein one or more of the ridges each comprise a surface pair intersecting along the respective peak at a ridge angle of between 50 to 80 degrees.

Example 14. The shaped cutter of any of Examples 1 to 13, wherein the periphery of the cutting table comprises an outward camber from the cutter-substrate interface.

Example 15. The shaped cutter of Example 14, wherein the outward camber defines a camber angle of between 0 and 10 degrees with respect to the cutter axis.

Example 16. A drill bit comprising: a bit body comprising one or more blades each having one or more cutter pockets; and one or more shaped cutters secured in a respective one of the cutter pockets, each shaped cutter comprising a substrate having a proximal end and a distal end, wherein the substrate defines a cutter axis passing centrally through the proximal and distal ends, and a cutting table secured to the proximal end of the substrate at a cutter-substrate interface, the cutting table including a periphery and a plurality of ridges each extending across the cutting table from one location on the periphery to another location on the periphery, each ridge comprising a peak and a valley on each side of and axially below the peak and having a ridge height from the peak to an orthogonal plane along the cutter-substrate interface, wherein the cutting table is convex along a first cross-section perpendicular to the ridges and concave along a second cross-section parallel with the ridges.

Example 17. The drill bit of Example 16, wherein the bit body defines a bit axis about which the bit body rotates during drilling, and wherein at least one of the shaped cutters is oriented to define an internal back rake angle with the ridges along the second cross-section.

Example 18. The drill bit of Example 17, wherein the internal back rake angle of between 5 to 10 degrees.

Example 19. A drilling method, comprising: rotating a drill bit about a bit axis, the drill bit comprising a bit body with one or more blades each having one or more cutter pockets and one or more shaped cutters secured in a respective one of the cutter pockets, each shaped cutter comprising a substrate having a proximal end and a distal end, wherein the substrate defines a cutter axis passing centrally through the proximal and distal ends, and a cutting table secured to the proximal end of the substrate at a cutter-substrate interface, the cutting table including a periphery and a plurality of ridges each extending across the cutting table from one location on the periphery to another location on the periphery, each ridge comprising a peak and a valley on each side of and axially below the peak and having a ridge height from the peak to an orthogonal plane along the cutter-substrate interface, wherein the cutting table is convex along a first cross-section perpendicular to the ridges and concave along a second cross-section parallel with the ridges; and axially engaging a formation to be drilled with the drill bit while rotating the drill bit.

Example 20. The drilling method of Example 19, further comprising using the plurality of ridges to simultaneously generate multiple cracks in the formation.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A shaped cutter for a fixed cutter drill bit, the shaped cutter comprising:

a substrate having a proximal end and a distal end, wherein the substrate defines a cutter axis passing centrally through the proximal and distal ends; and a cutting table secured to the proximal end of the substrate at a cutter-substrate interface, the cutting table including a periphery and a plurality of ridges each extending across the cutting table from one location on the periphery to another location on the periphery, each ridge comprising a peak and a valley on each side of and axially below the peak and having a ridge height from the peak to an orthogonal plane along the cutter-substrate interface, wherein the cutting table is convex along a first cross-section perpendicular to the ridges and concave along a second cross-section parallel with the ridges, wherein the ridge heights of the ridges increase consecutively in the first cross-section from the periphery of the cutting table toward the cutter axis, and wherein a distance from each valley to the orthogonal plane increases in the first cross-section from the periphery of the cutting table toward the cutter axis.

2. The shaped cutter of claim 1, wherein the plurality of ridges include a central ridge passing through the cutter axis.

3. The shaped cutter of claim 1, wherein the peaks in the first cross-section lie along a slope angle of between 5 and 15 degrees with respect to the orthogonal plane.

4. The shaped cutter of claim 1, wherein the valleys in the first cross-section lie along a slope angle of between 5 and 15 degrees with respect to the orthogonal plane.

5. The shaped cutter of claim 1, wherein one or more of the ridges each comprise a surface pair intersecting along the respective peak at a ridge angle of between 50 to 140 degrees.

6. The shaped cutter of claim 1, wherein one or more of the ridges each comprise a surface pair intersecting along the respective peak at a ridge angle of between 50 to 80 degrees.

7. The shaped cutter of claim 1, wherein the periphery of the cutting table comprises an outward camber from the cutter-substrate interface.

8. The shaped cutter of claim 7, wherein the outward camber defines a camber angle of between 0 and 10 degrees with respect to the cutter axis.

9. A shaped cutter for a fixed cutter drill bit, the shaped cutter comprising:

a substrate having a proximal end and a distal end, wherein the substrate defines a cutter axis passing centrally through the proximal and distal ends; and a cutting table secured to the proximal end of the substrate at a cutter-substrate interface, the cutting table including a periphery and a plurality of ridges each extending across the cutting table from one location on the periphery to another location on the periphery, each ridge comprising a peak and a valley on each side of and axially below the peak and having a ridge height from the peak to an orthogonal plane along the cutter-substrate interface, wherein the cutting table is convex along a first cross-section perpendicular to the ridges and concave along a second cross-section parallel with the ridges, wherein the ridge height of each ridge decreases from the periphery of the cutting table toward the cutter axis, and wherein the ridge height of each ridge decreases from the periphery of the cutting table all the way to the cutter axis.

10. The shaped cutter of claim 9, wherein the ridge height of each ridge decreases along a slope angle of between 5 and 15 degrees from the periphery of the cutting table toward the cutter axis.

11. A drill bit comprising:

a bit body comprising one or more blades each having one or more cutter pockets; and one or more shaped cutters secured in a respective one of the cutter pockets, each shaped cutter comprising a substrate having a proximal end and a distal end, wherein the substrate defines a cutter axis passing centrally through the proximal and distal ends, and a cutting table secured to the proximal end of the substrate at a cutter-substrate interface, the cutting table including a periphery and a plurality of ridges each extending across the cutting table from one location on the periphery to another location on the periphery, each ridge comprising a peak and a valley on each side of and axially below the peak and having a ridge height from the peak to an orthogonal plane along the cutter-substrate interface, wherein the cutting table is convex along a first cross-section perpendicular to the ridges and concave along a second cross-section parallel with the ridges, wherein the ridge heights of the ridges increase consecutively in the first cross-section from the periphery of the cutting table toward the cutter axis, and wherein a distance from each valley to the orthogonal plane increases in the first cross-section from the periphery of the cutting table toward the cutter axis.

12. The drill bit of claim 11, wherein the bit body defines a bit axis about which the bit body rotates during drilling, and wherein at least one of the shaped cutters is oriented to define an internal back rake angle (φ) with the ridges along the second cross-section.

13. The drill bit of claim 11, wherein the plurality of ridges include a central ridge passing through the cutter axis.

14. The drill bit of claim 11, wherein the peaks in the first cross-section lie along a slope angle of between 5 and 15 degrees with respect to the orthogonal plane.

15. The drill bit of claim 11, wherein the periphery of the cutting table comprises an outward camber from the cutter-substrate interface.

16. A drilling method, comprising:

rotating a drill bit about a bit axis, the drill bit comprising a bit body with one or more blades each having one or more cutter pockets and one or more shaped cutters secured in a respective one of the cutter pockets, each shaped cutter comprising a substrate having a proximal end and a distal end, wherein the substrate defines a cutter axis passing centrally through the proximal and distal ends, and a cutting table secured to the proximal end of the substrate at a cutter-substrate interface, the cutting table including a periphery and a plurality of ridges each extending across the cutting table from one location on the periphery to another location on the periphery, each ridge comprising a peak and a valley on each side of and axially below the peak and having a ridge height from the peak to an orthogonal plane along the cutter-substrate interface, wherein the cutting table is convex along a first cross-section perpendicular to the ridges and concave along a second cross-section parallel with the ridges; and axially engaging a formation to be drilled with the drill bit while rotating the drill bit, wherein the ridge heights of the ridges increase consecutively in the first cross-section from the periphery of the cutting table toward the cutter axis, and wherein a distance from each valley to the orthogonal plane increases in the first cross-section from the periphery of the cutting table toward the cutter axis.

17. A drill bit comprising:

a bit body comprising one or more blades each having one or more cutter pockets; and one or more shaped cutters secured in a respective one of the cutter pockets, each shaped cutter comprising a substrate having a proximal end and a distal end, wherein the substrate defines a cutter axis passing centrally through the proximal and distal ends, and a cutting table secured to the proximal end of the substrate at a cutter-substrate interface, the cutting table including a periphery and a plurality of ridges each extending across the cutting table from one location on the periphery to another location on the periphery, each ridge comprising a peak and a valley on each side of and axially below the peak and having a ridge height from the peak to an orthogonal plane along the cutter-substrate interface, wherein the cutting table is convex along a first cross-section perpendicular to the ridges and concave along a second cross-section parallel with the ridges, wherein the ridge height of each ridge decreases from the periphery of the cutting table toward the cutter axis, and wherein the ridge height of each ridge decreases from the periphery of the cutting table all the way to the cutter axis.

18. The drill bit of claim 17, wherein the ridge height of each ridge decreases along a slope angle of between 5 and 15 degrees from the periphery of the cutting table toward the cutter axis.

19. A drilling method, comprising:

rotating a drill bit about a bit axis, the drill bit comprising a bit body with one or more blades each having one or more cutter pockets and one or more shaped cutters secured in a respective one of the cutter pockets, each shaped cutter comprising a substrate having a proximal end and a distal end, wherein the substrate defines a cutter axis passing centrally through the proximal and distal ends, and a cutting table secured to the proximal end of the substrate at a cutter-substrate interface, the cutting table including a periphery and a plurality of ridges each extending across the cutting table from one location on the periphery to another location on the periphery, each ridge comprising a peak and a valley on each side of and axially below the peak and having a ridge height from the peak to an orthogonal plane along the cutter-substrate interface, wherein the cutting table is convex along a first cross-section perpendicular to the ridges and concave along a second cross-section parallel with the ridges; and axially engaging a formation to be drilled with the drill bit while rotating the drill bit, wherein the ridge height of each ridge decreases from the periphery of the cutting table toward the cutter axis, and wherein the ridge height of each ridge decreases from the periphery of the cutting table all the way to the cutter axis.

20. The drilling method of claim 19, wherein the ridge height of each ridge decreases along a slope angle of between 5 and 15 degrees from the periphery of the cutting table toward the cutter axis.

* * * * *